US005454607A

United States Patent [19]

Ishihara et al.

[11] Patent Number: 5,454,607

[45] Date of Patent: Oct. 3, 1995

[54] DOOR CLOSING DEVICE

[75] Inventors: Hiroshi Ishihara; Yoshinobu Ogura, both of Kariya, Japan

[73] Assignee: Alsin Seiki Kabushiki Kaisha, Kariya, Japan

[21] Appl. No.: 99,591

[22] Filed: Jul. 30, 1993

[30] Foreign Application Priority Data

Jul. 30, 1992 [JP] Japan ..... 4-204097

[51] Int. Cl.[6] ..... E05C 3/06

[52] U.S. Cl. ..... 292/201; 292/341.16; 292/DIG. 23; 292/DIG. 43

[58] Field of Search ..... 292/201, 216, 292/DIG. 23, DIG. 65, DIG. 43, 341.16, DIG. 25, 341.12

[56] References Cited

U.S. PATENT DOCUMENTS

| | | | |
|---|---|---|---|
| Re. 27,390 | 6/1972 | Allen | 292/DIG. 25 |
| 4,934,746 | 6/1990 | Yamada | 292/201 |
| 4,978,154 | 12/1990 | Kleefeldt et al. | 292/216 X |
| 4,986,579 | 1/1991 | Ishikawa | 292/201 |
| 5,180,198 | 1/1993 | Nakamura et al. | 292/DIG. 43 X |
| 5,222,775 | 6/1993 | Kato | 292/216 X |

FOREIGN PATENT DOCUMENTS 3409996 9/1985 Germany .

*Primary Examiner*—Rodney M. Lindsey
*Attorney, Agent, or Firm*—Burns, Doane, Swecker & Mathis

[57] ABSTRACT

A door closing device comprises a door-lock mechanism provided between a door and a body and including a striker secured to the body and a pawl provided on the door, a driving mechanism, and a door-closing mechanism for establishing a fully closed condition of the door relative to the body, the door-closing mechanism including an active-lever operatively connected to the driving mechanism, a passive-lever operatively connected to the door-lock mechanism, and a cancel-lever disposed between the active-lever and the passive-lever. The cancel-lever is rotatable relative to one of the active-lever and the passive-lever so as to be brought into engagement with a portion of the other of the active-lever and the passive-lever.

11 Claims, 9 Drawing Sheets

DOOR CLOSING DEVICE

BACKGROUND OF THE INVENTION

1. Field of the Invention

The present invention relates to a door closing device and in particular to a door closing device for bringing a door which is in an imperfectly closed condition into a perfectly closed condition.

2. Description of the Prior Art

U.S. Pat. No. 4,986,579 granted to Ishikawa on Jan. 22, 1991, discloses a door closing device which, in order to bring a door from an imperfectly closed condition into a perfectly closed condition, includes a door-closing mechanism that is associated with a door-lock mechanism. That is, the door-closing mechanism has an active-lever which is intended to be rotated, and a passive-lever that is operatively connected to a door-lock mechanism. The resultant rotation of the active-lever is transmitted via a pin supported on the active-lever to the passive-lever to result in rotation of the passive-lever. Thus, the door-lock mechanism is actuated to cause the door to be brought into a perfectly closed condition. In the foregoing structure, it is sometimes necessary to interrupt the linkage between the active-lever and the passive-lever for stopping further movement of the door. Such a situation may arise when a finger or other object is held between the door and the vehicle body. To effect such an interruption, the pin is set to be disengaged from the passive-lever.

However, in order to move the pin away from the passive-lever to interrupt the linkage between the active-lever and the passive-lever, the device must be provided with a cancel-lever and a passage into which the pin escapes for permitting no movement of the active-lever and for permitting no rotation of the active-lever while the active-lever is out of engagement with the passive-lever upon actuation of the cancel-lever. Thus, the structure of the door closing mechanism is constructionally complex.

SUMMARY OF THE INVENTION

It is therefore, an object of the present invention to provide a door closing device without the foregoing drawback.

It is another object of the present invention to provide a door closing device which is simple in construction.

In order to achieve these objects, a door closing device comprises a door-lock mechanism provided between a door and a body and including a striker secured to the body and a pawl provided on the door, a driving mechanism, and a door-closing mechanism for establishing a perfectly or substantially perfectly closed condition of the door relative to the body. The door-closing mechanism includes an active-lever operatively connected to the driving mechanism, a passive-lever operatively connected to the door-lock mechanism, and a cancel-lever disposed between the active-lever and the passive-lever. The cancel-lever is rotatable relative to one of the active-lever and the passive-lever so as to be brought into engagement with a portion of the other of the active-lever and the passive-lever.

BRIEF DESCRIPTION OF THE DRAWINGS

Additional objects and advantages of the present invention will become more apparent from the following detailed description of preferred embodiments thereof when considered with reference to the attached drawings, in which.

DETAILED DESCRIPTION OF THE INVENTION

Figure 1:
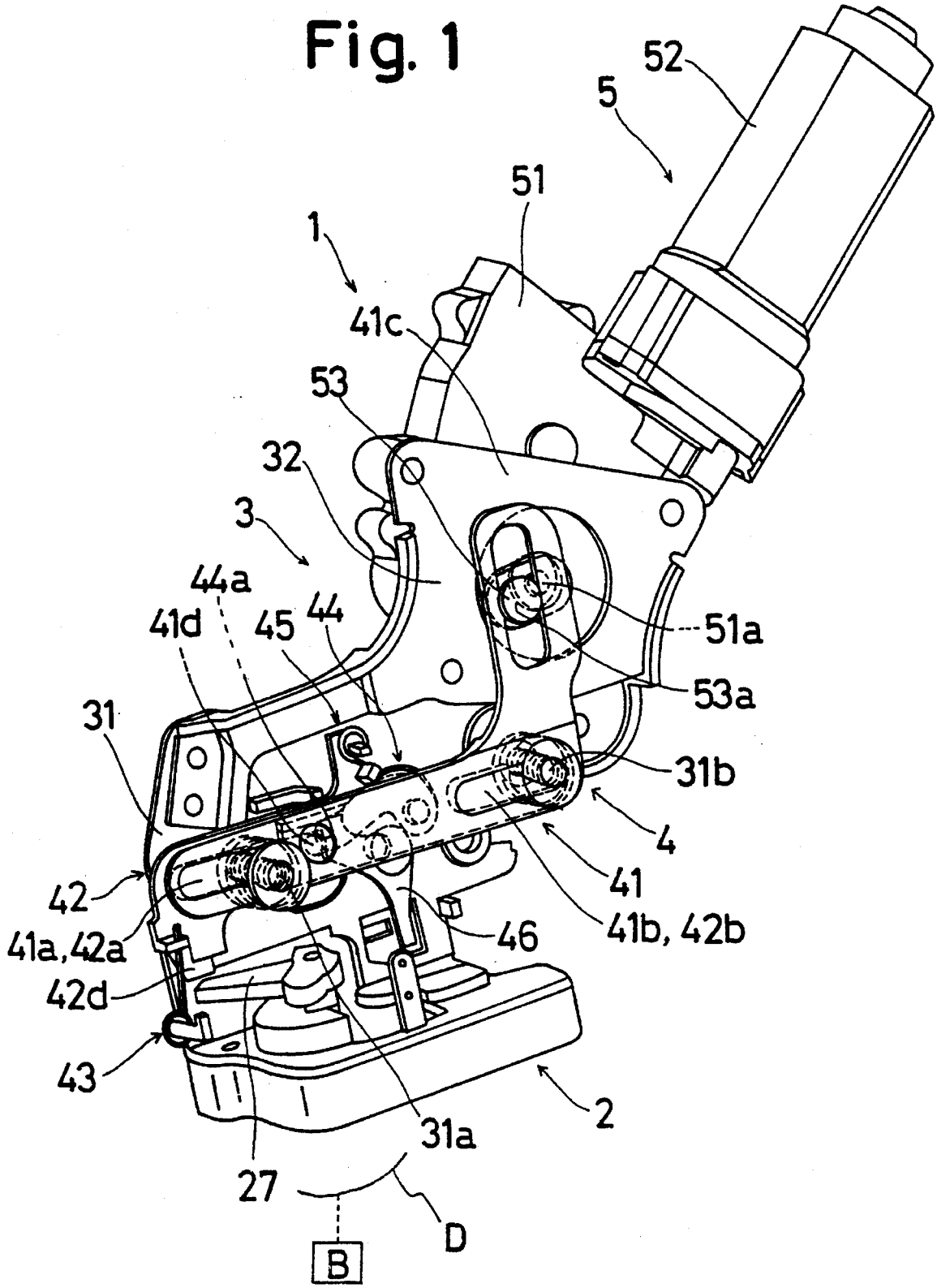
FIG. 1 is a perspective view of a door closing device in accordance with the present invention.

Referring to FIG. 1, a door closing device 1 includes a door-lock mechanism 2 accommodated in a door D of a vehicle body B, a supporting member 3 having a pair of adjacent brackets 31 and 32, a closing mechanism 4 mounted on the supporting member 3 which is associated with the door-lock mechanism 2, and a driving mechanism 5 which is associated with the closing mechanism 4.

Figure 2:
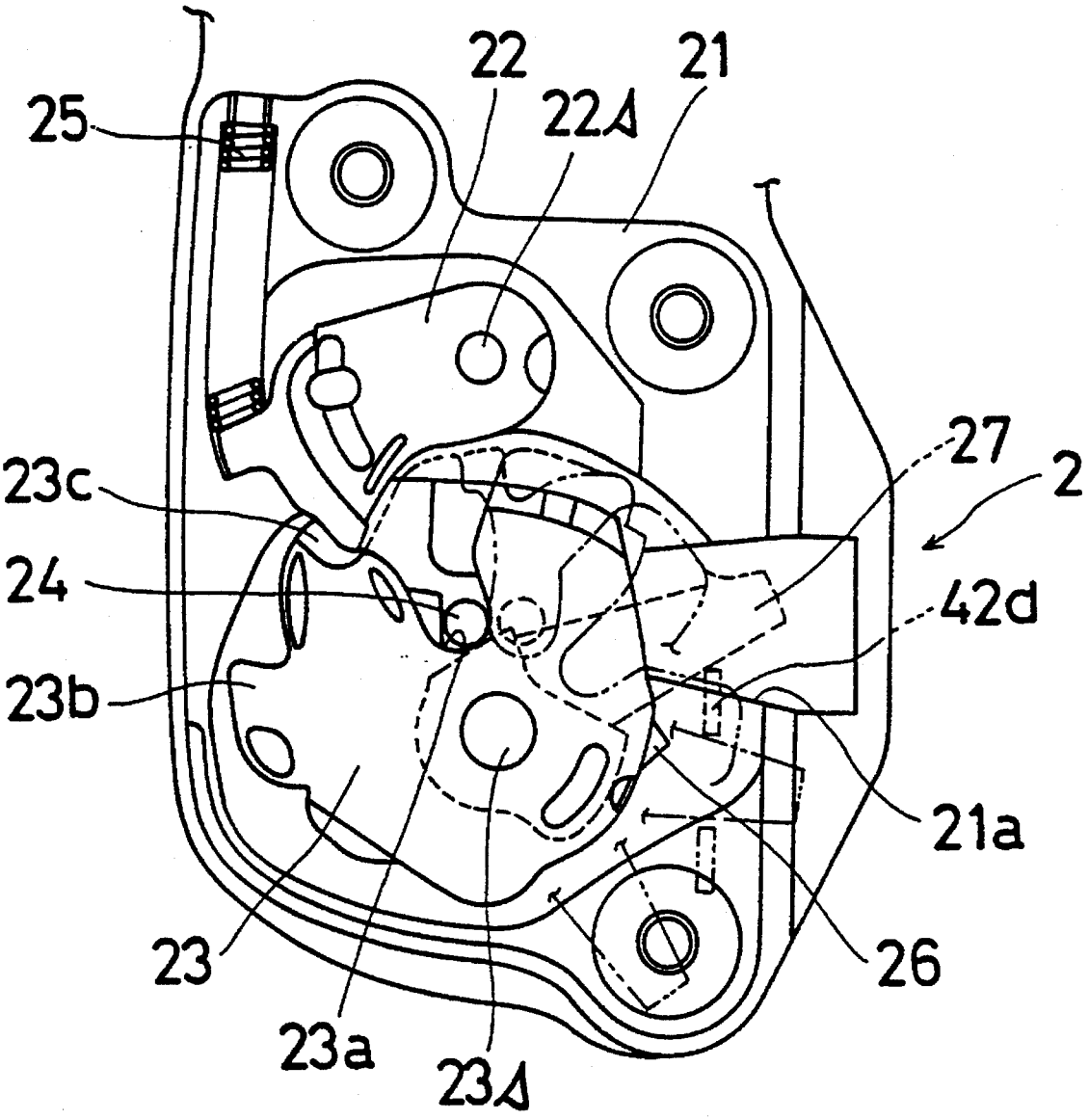
FIG. 2 is a plan view of a door lock mechanism of the device shown in FIG. 1.

The door-lock mechanism 2, which is best shown in FIG. 2, has a casing 21 in which are rotatably mounted a pawl 22 and a latch member 23. The pawl 22 and the latch member 23 are rotatably mounted on a pawl shaft 22*s* and a latch shaft 23*s*, respectively. The latch member 23 is provided with two projections 23*b*, 23*c* and a groove 23*a* which is set to be brought into engagement with a striker 24. Each of the projections 23*b*, 23*c* is set to be brought into engagement with the pawl 22 when the striker 24 engages the groove 23*a*. The striker 24 is secured to the vehicle body B and is adapted to be moved along a groove 21*a* in the casing 21 during the closing movement of the door D. The pawl 22 is continually urged by a spring 25 so as to be engaged with one of the projections 23*b*, 23*c* of the latch member 23. The latch member 23 is continually urged by a spring 26 so as to be moved away from the striker 24. The latch-lever 27 is adapted to be located in a full-latched position, a half-latched position, and an unlatched position in this order in the clockwise direction FIG. 2.

When the projection 23*b* engages the pawl 22, the latch member 23 is prevented from being rotated, which maintains the door D in the half-latched condition. When the projection 23*c* engages the pawl 22, the latch 23 is prevented from being rotated, which maintains the door D in the full-latched condition. Moreover, in a well-known manner, the pawl 22 is operatively connected to an inside door-handle (not shown) and an outside door-handle (not shown), both of which are used for opening the door D. The pawl 22 is also operatively associated with an open-lever (not shown) which is adapted to rotate the pawl 22 in order that the pawl 22 may be moved away from the projection 23*b* or 23*c*. The latch shaft 23*s* extends outwardly and a distal end portion of the latch shaft 23*s* is secured to the latch-lever 27 so as to be rotated in unison therewith. Also, the latch-lever 27 is operatively associated with the closing mechanism 4 as will be described below. It is to be noted that the closing movement of the door D is effected by pushing the door D toward the vehicle body B.

Figure 3:
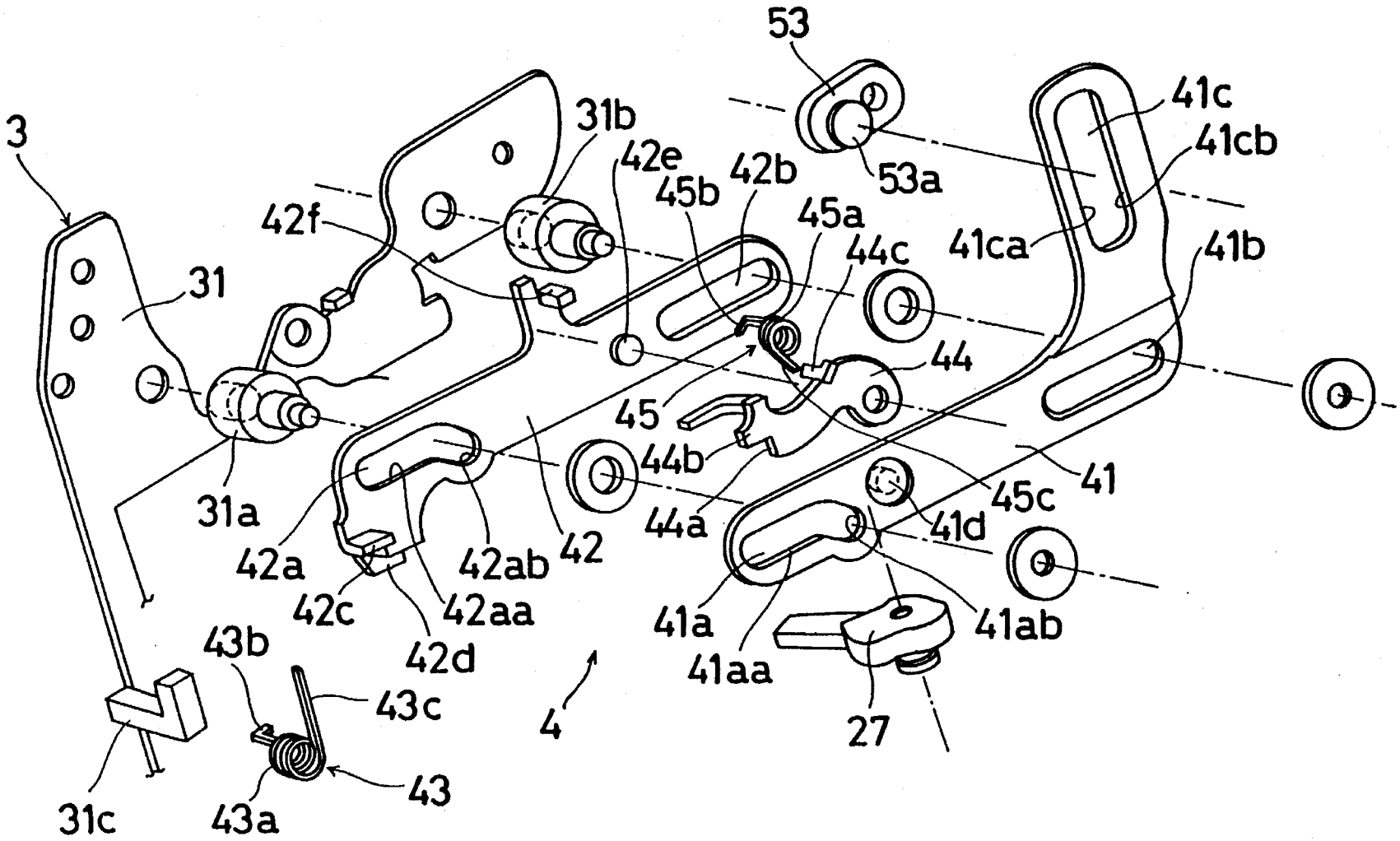
FIG. 3 is an exploded perspective view of a closing mechanism of the device shown in FIG. 1.
Figure 4:
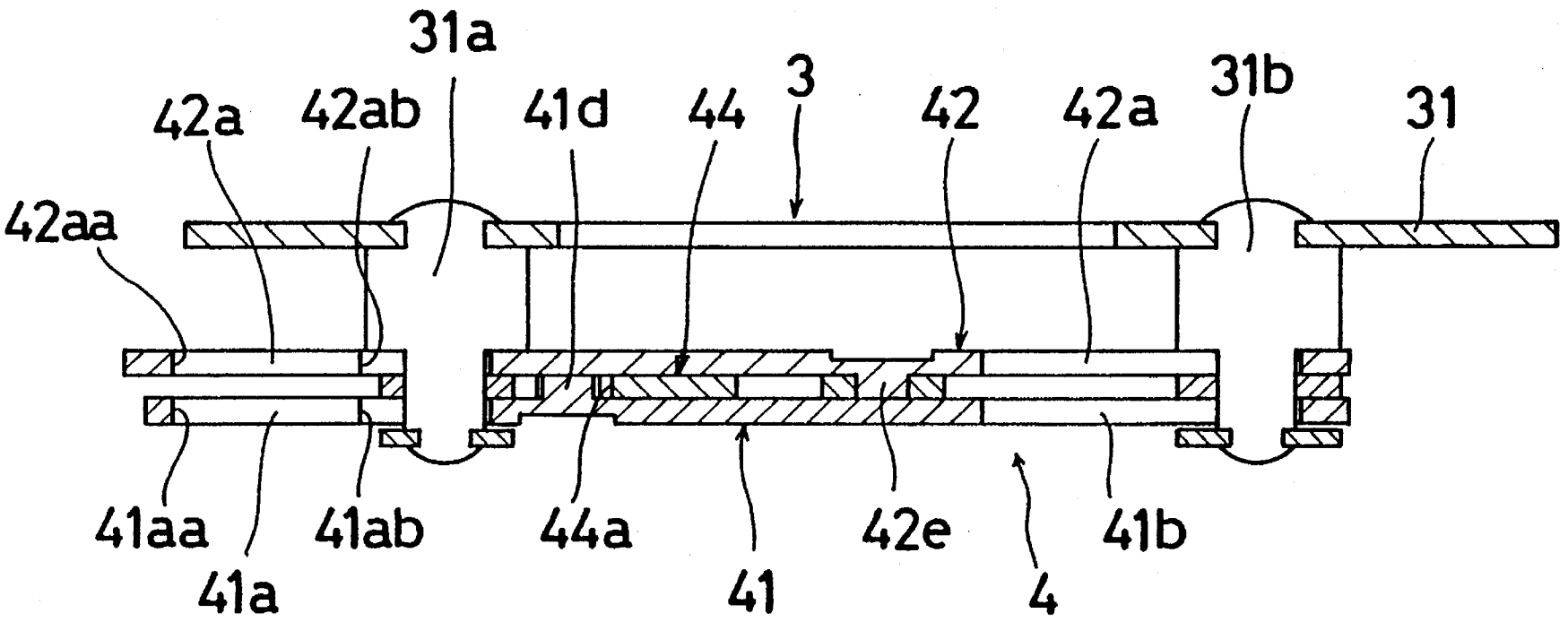
FIG. 4 is a horizontal cross-sectional view of the closing mechanism shown in FIG. 3.

The closing mechanism 4 will be detailed with reference to FIGS. 1, 3, and 4. On the casing 21 there is secured the bracket 31 which possesses a substantially L-shape. The bracket 31 is provided with a set of spaced support shafts 31*a* and 31*b*. The support shaft 31*a* is in sliding engagement with a slot 41*a* of an active-lever 41 and a slot 42*a* of a passive-lever 42. The support shaft 31*b* is in sliding engagement with a slot 41*b* of the active-lever 41 and a slot 42*b* of the passive-lever 42. The slots 41*a*, 42*a* (41*b*, 42*b*) are identical or substantially identical in shape, width, and length. Thus, the active-lever 41 and the passive-lever 42 are movable within a distance defined by each of the slots.

The slot 41*a* (42*a*) has a horizontal portion 41*aa* (42*aa*) which establishes a horizontally straight line of movement of the active-lever 41 (the passive-lever 42) and an inclined portion 41 *ab* (42*ab*) which establishes a rotation of the active-lever 41 (the passive-lever 42) through an angle. The active-lever 41 is also provided with a slot 41*c* which is operatively associated with the driving mechanism 5 which will be described in more detail below.

Figure 8:
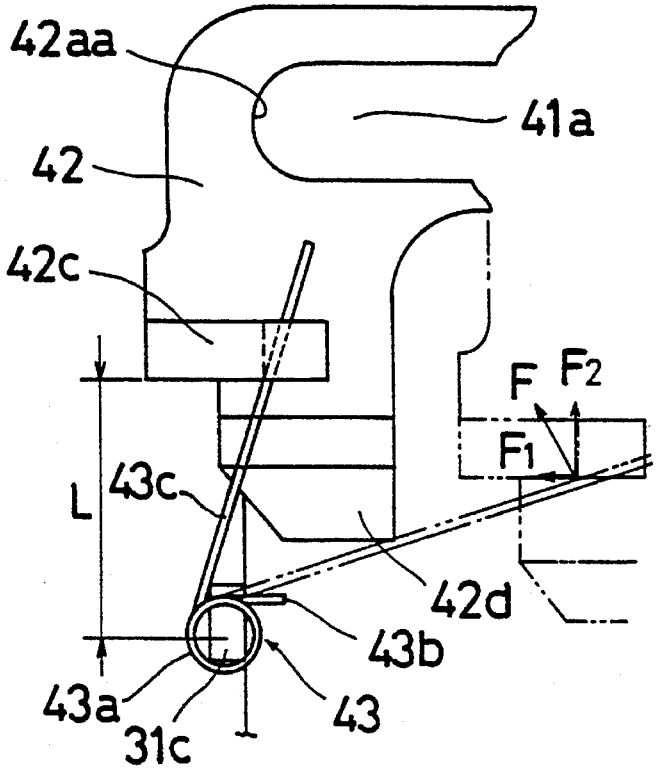
FIG. 8 is an enlarged view of a portion of the door closing device shown in FIG. 1 illustrating one embodiment of a torsion spring used in the closing mechanism.

The passive-lever 42 is provided with an engaging portion 42*d* which is engageable with the latch-lever 27 and which is perpendicular to a rotating portion of the latch-lever 27. A torsion spring 43 is disposed between the bracket 31 and the passive-lever 42 in such a manner that a winding portion 43*a* of the torsion spring 43 is mounted on a hook portion 31*c* of the bracket 31. One end portion 43*b* of the torsion spring 43 engages the bracket 31, and the other end portion 43*c* of the torsion spring 43 engages a projection 42*c* of the passive-lever 42. The passive-lever 42 is rotated or urged in the leftward direction in FIG. 1, by which the passive-lever 42 is kept at its initial position or the illustrated position shown in FIG. 1. In the initial position, the support shaft 31*a* is disposed in both of the inclined portions 41 *ab* and 42*ab*, and the support shaft 31*b* is in the rightmost portion of each of the slots 41*b*, 42*b*. The torsion spring 43 maintains the passive-lever 42 in its original position. As shown in FIG. 8, the span L between the engaging portion 42*c* and the engaging portion 31*c* can be reduced as compared to convention devices.

A projection shaft 42*e* which is oriented toward the active-lever 41 is formed on the passive-lever 42 by pressing (i.e., it is press-formed). A cancel-lever 44 is rotatably mounted on the projection shaft 42*e* such that the cancel-lever 44 is disposed between the active-lever 41 and the passive-lever 42. At a distal end portion of the cancel-lever 44, there are formed a pressing wall 44*a* and a regulating wall 44*b*. The active-lever 41 is provided with a press-formed projection 41*d* which is oriented toward the passive-lever 42 so as to be engaged with and disengaged from the pressing wall 44*a* and the regulating wall 44*b* when the cancel-lever 44 is rotated. The cancel-lever 44 is operatively connected to the open-lever via a lever 46 (FIG. 1). A torsion spring 45 is disposed between the passive-lever 42 and the cancel-lever 44 in such a manner that a winding portion 45*a* of the spring 45 is mounted on a projection 42*f* of the passive-lever 42. One end portion of the spring 45 is engaged with a projection 42*f* of the passive-lever 42 and the other end portion of the spring 45 is engaged with a projection 44*c* of the cancel-lever 44. The torsion spring 43 urges the cancel-lever 44 in the counter-clockwise direction as seen in FIG. 1 so as to maintain a locked condition under which the projection 41*d* engages both the pressing wall 44*a* and the regulating wall 44*b*.

Referring back to FIG. 1, the driving mechanism 5 has a reducer 51 which is in the form of a combination of a plurality of gears (not shown). The reducer 51 is secured to the bracket 32 which is fixed to the bracket 31. An input shaft (not shown) of the reducer 51 is connected to a motor 52, and an output shaft 51*a* of the reducer 51 is secured to a cam lever 53. The cam lever 53 has a cam shaft 53*a* which, upon being rotated, is adapted to be brought into engagement with a side wall 41*ca* or a side wall 41*cb* of the slot 41*c* of the active-lever 41.

Figure 5:
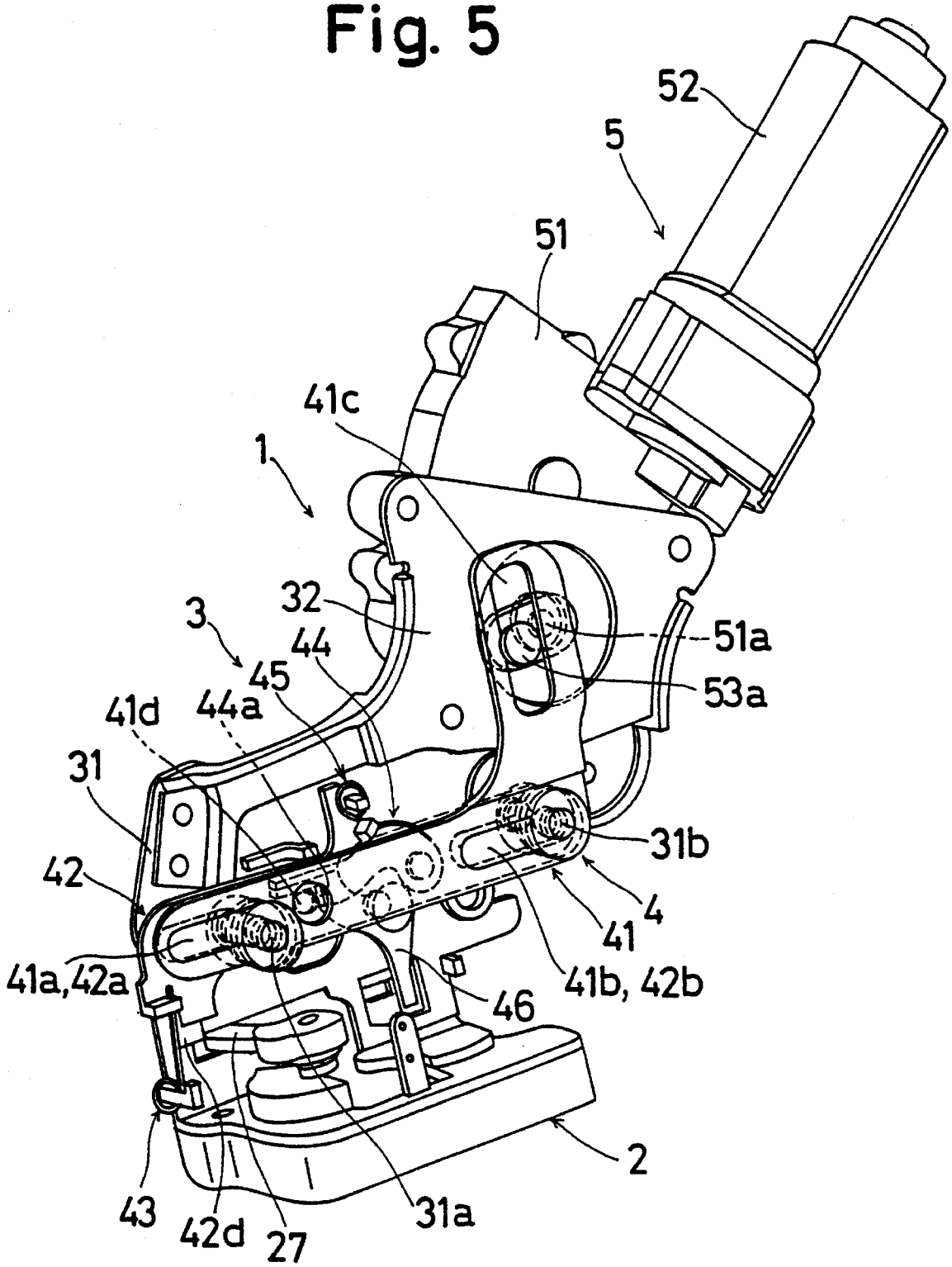
FIG. 5 is a perspective view of the device shown in FIG. 1 wherein a door is brought into a half-latched condition by the locking mechanism.

In operation, as the door D is moved towards the closed position, the striker 24 is brought into movement along the groove 21*a* of the casing 21, and is engaged with the groove 23*a* of the latch member 23, which results in rotation of the latch member 23. Thus, the door is brought into the half-latched condition. At this time, the latch-lever 27 is also rotated as it is transferred to a position shown in FIG. 5. During transfer of the latch lever 27 from the position shown in FIG. 1 to the position shown in FIG. 5, the engaging portion 42*d* of the passive-lever 42 is offset from the locus of the rotation of the latch-lever 27 (i.e., is offset from the plane of rotation of the latch-lever 27) due to the fact that the supporting shaft 31*a* is in the inclined portion 42*ab* of the slot 42*a* in the passive-lever 42. Thus, the rotation of the latch member 23 is not prevented.

Figure 6:
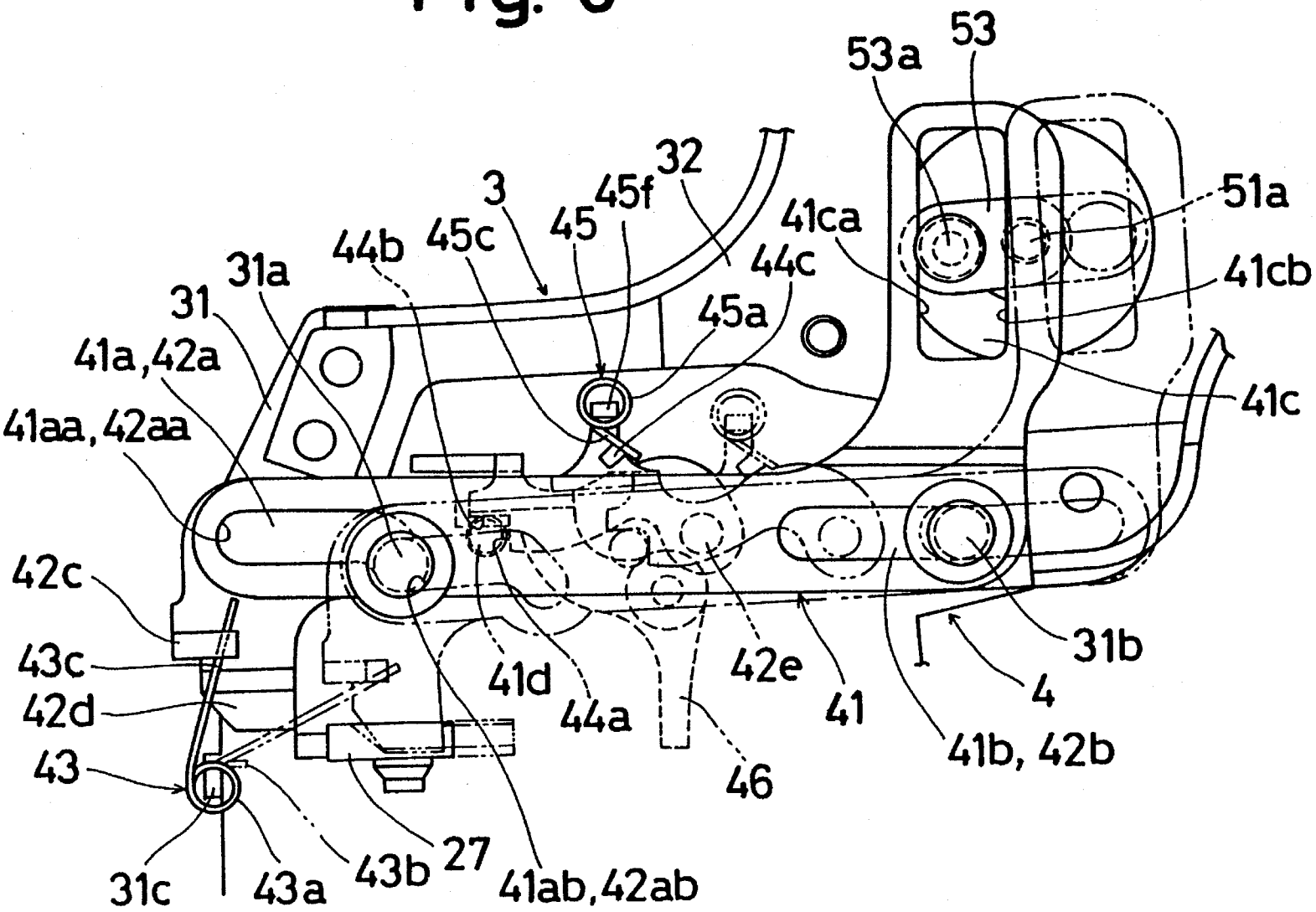
FIG. 6 is a side view of the door closing device of FIG. 1 showing an operation of the device.

With reference to FIG. 6, immediately upon detection of the half-latched condition of the door by a switch means (not shown), the motor 52 is turned on, thereby rotating the cam-lever 53. As a result of the rotation of the cam-lever 53, the cam-shaft 53*a* urges or pushes against the side wall 41*cb* of the slot 41*c* of the active-lever 41. Thus, the active-lever 41, which is located in the full-line position shown in FIG. 6, is brought into straight-line movement in the rightward direction.

In light of the fact that the wall 44*a* of the cancel-lever 44 is under a biasing force of the projection 41*d* of the active-lever 41, the straight-line movement of the active-lever 41 is transmitted via the cancel-lever 44 to the passive-lever 42. Thus, the passive-lever 42, which is located at the full line position or its initial position shown in FIG. 6, is brought into straight-line movement in the rightward direction against the torsion spring 43. Such movement of the active-lever 41 (the passive-lever 42) is established along the slot 41*a* and the slot 41*b* (the slot 42*a* and the slot 42*b*) so that at an initial stage of this movement the inclined portion 41*ab* (42*ab*) of the slot 41*a* (42*a*) of the active-lever 41 (the passive-lever 42) causes rotation of the active-lever 41 (the passive-lever 42) about the support shaft 31*b*. That is, the active-lever 41 (the passive-lever 42) is moved from its initial position to a lower side portion in FIG. 6 as a result of the guidance of the inclined portion 41*ab* (42*ab*) of the slot 41*a* (42*a*). Thereafter, as a result of the guidance of the horizontal portion 41*aa* (42*aa*) of the active-lever 41 (the passive-lever 42), the active-lever 41 is brought into horizontal movement to the two-dotted chain line position or the operating position shown in FIG. 6.

Figure 10:
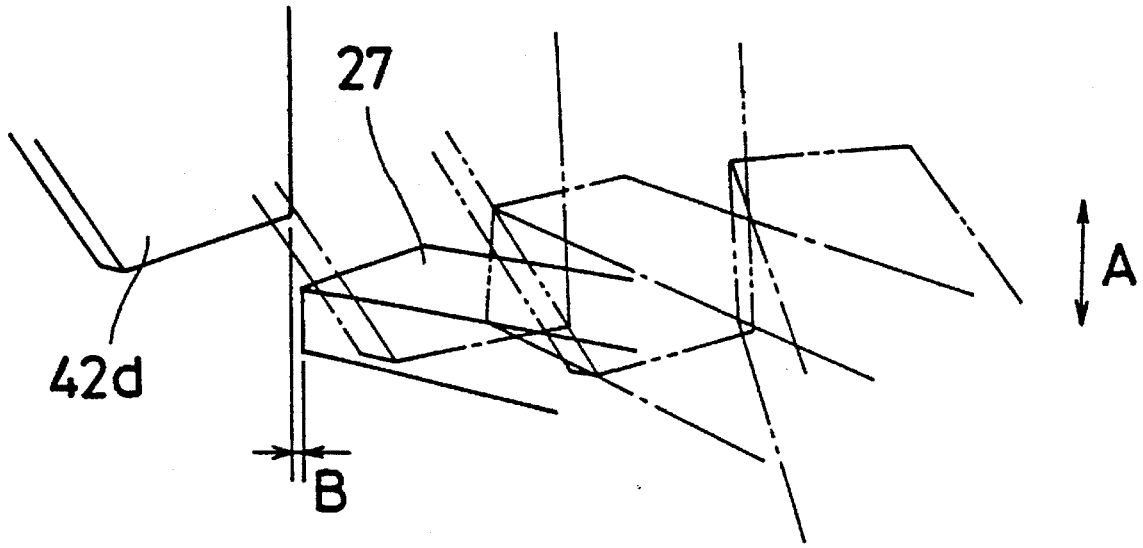
FIG. 10 is an enlarged perspective view of a portion of the door closing device at which a passive-lever is in engagement with a latch member.

The engaging portion 42*d* of the passive-lever 42 is brought into engagement with the latch-lever 27, thereby rotating the latch member 23. Thus, the latch member 23 is brought into the full-latched condition as shown in the full line position illustrated in FIG. 2 and therefore, the striker 24 is pulled into a position which represents the full-closed condition of the door. While the latch-lever 27 is being pulled, a sliding movement between the engaging portion 42*d* and the latch-lever 27 is only oriented in the direction A as shown in FIG. 10, which allows the loss of torque transmission from the engaging portion 42*d* to the latch-lever 27 to be lessened. Thus, less output power of the motor 52 enables rotation of the latch member 23, which results in smooth operation of the device and miniaturization of the motor 52.

After establishment of the full-latched condition of the latch member 23, the motor 52 continues to move the cam-lever 53 further which results in the cam shaft 53*a* being brought into engagement with the side wall 41*ca* of the slot 41*c*. Thus, the active-lever 41 is returned to its original position and the passive-lever 42 is also returned to its original position as a result of the urging force of the torsion spring 43. The engaging portion 42*d* of the passive-lever 42 is offset from the locus (i.e., the plane) of rotation of the latch-lever 27, which is similar to the offset of the passive-lever 42, during the change of the condition shown in FIG. 1 to that shown in FIG. 5. Thereafter, the rotation of the latch member 23 for opening the door, which is established by the actuation of the inside door-handle or the outside door handle, cannot be disturbed by interference between the latch-lever 27 and the engaging portion 42*d* of the passive-lever 42. It is to be noted that the motor 52 is expected to be turned off automatically after a predetermined time has elapsed from the detection of the full-latched condition of the latch member 23. If the door is quickly transferred from the opened condition to the full-closed condition without being positioned at the half-closed condition, the half-closed condition of the door is not detected, thereby omitting the operation of the closing mechanism 4.

Figure 7:
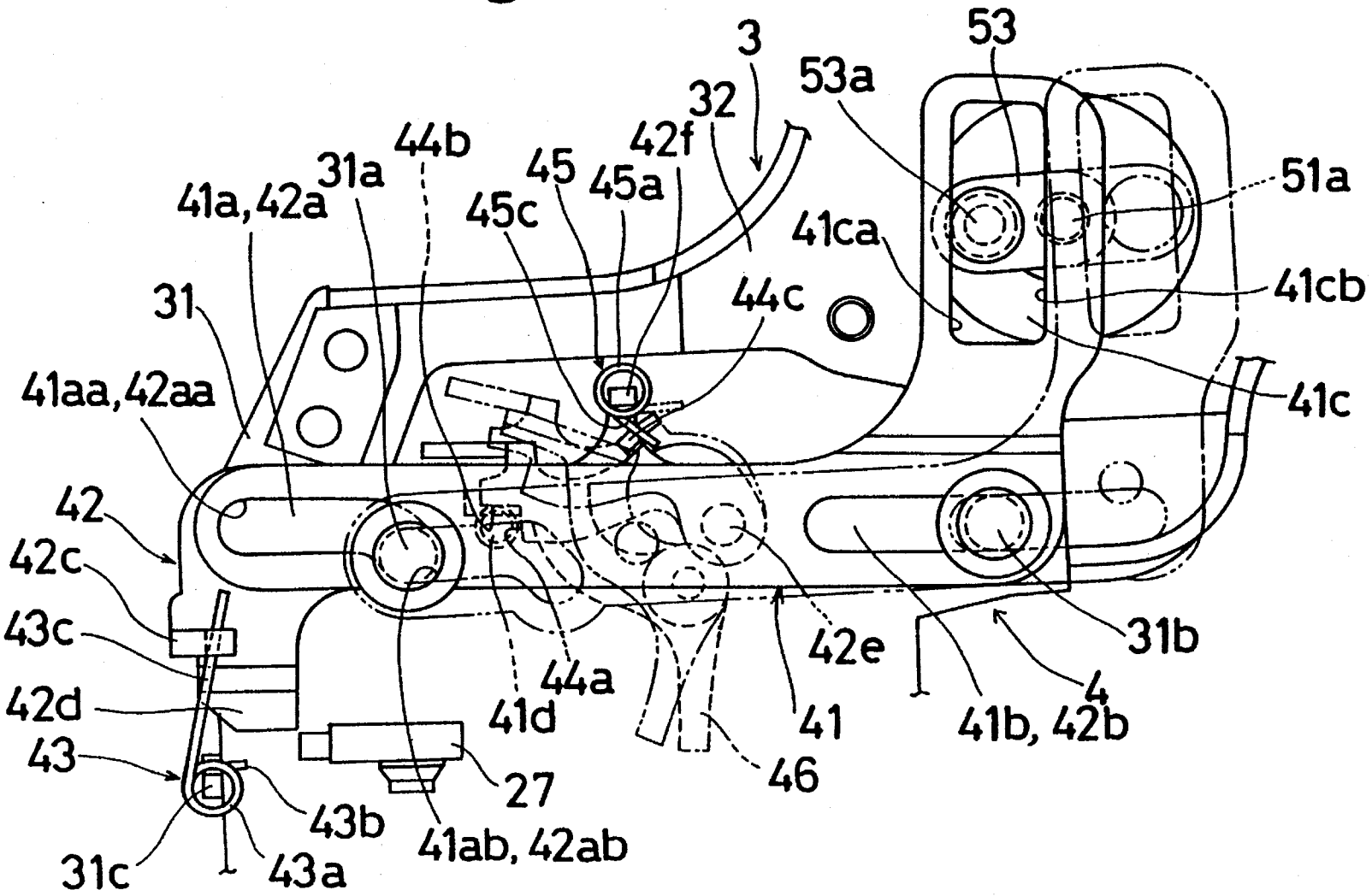
FIG. 7 is another side view of the door closing device of FIG. 1 showing an operation of the device.

As shown in FIG. 7, when the cancel-lever 44 is rotated in the clockwise direction by actuation of the inside door handle or the outside door handle during the transfer of the latch member 23 from the half-latched condition to the full-latched condition and when a finger or other object is being held between the door D and the vehicle body B, the projection 41*d* of the active-lever 41 is moved away from both the pressing wall 44*a* and the regulating wall 44*b* of the cancel-lever 44, which results in the unlocked condition. Thus, the movement of the active-lever 41 is prevented from being transmitted to the passive-lever 42. Consequently, only the active-lever 41 is brought into movement toward the two-dotted lined condition shown in FIG. 7. As a result, the movement of the passive-lever 42 is interrupted, thereby stopping the rotation of the latch member 23. This means that the transfer of the door from the half-latched condition to the full-latched condition is stopped. The passive-lever 42 is returned to its original position by the torsion spring 43. Further, due to the fact that the open-lever (not shown) is linked to the pawl 22 and the latch member 23 is released from the pawl 22, the latch member 23 is brought into the unlatched condition.

As mentioned above, the linkage between the active-lever 41 and the passive-lever 42 can be established (interrupted) upon engagement (disengagement) between the projection 41*d* of the active-lever 41 and both the pressing wall 44*a* and the regulating wall 44*b* of the cancel-lever 44 by rotating the cancel-lever 44. In brief, a mere installation of the cancel-lever 44 enables establishment and interruption of the linkage between the active-lever 41 and the passive-lever 42, which results in a simple construction of the closing mechanism 4.

Due to the fact that the projection 42*e* and the projection 41*d* are formed on the passive-lever 42 and the active-lever 41, respectively, by pressing (i.e., they are press-formed), the installation of the cancel-lever 44 can be established merely by providing a gap between the passive-lever 42 and the active-lever 41 which is equivalent to the thickness of the cancel-lever 44. Thus the thickness of the closing mechanism 4 per se can be reduced in comparison with the thickness of other known devices, thereby permitting the door closing device 1 to be installed into a narrow inner space of the door D.

As mentioned above, the interference between the latch-lever 27 and the engaging portion 42*d* can be avoided by offsetting the engaging portion 42*d* from the rotation locus (i.e., the plane of rotation) of the latch-lever 27. At this time, the urging or biasing force of the torsion spring 43 is oriented in a direction F (see FIG. 8) whose components F1 and F2 serve for urging the passive-lever 42 in the horizontal and inclined directions, respectively. This structure ensures a reduction in the number of elements or parts, and smooth return movement of the passive-lever 42 along the slot 41*a*.

Figure 9:
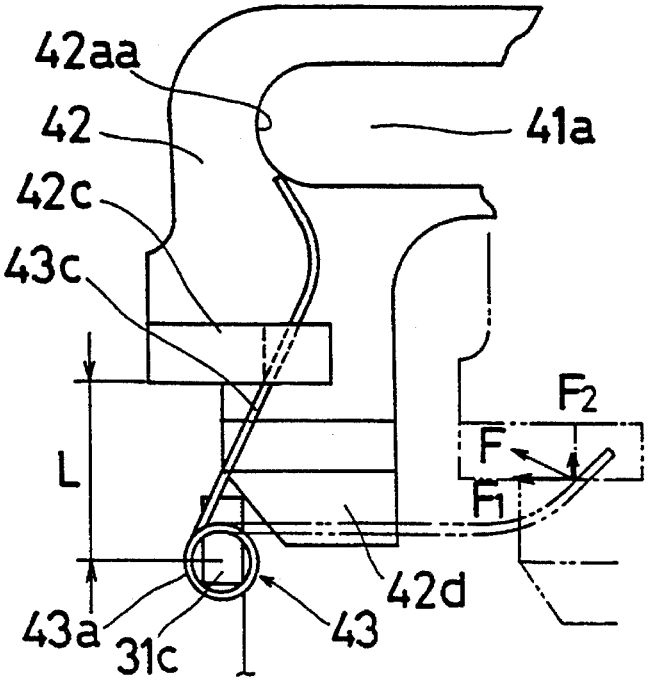
FIG. 9 is an enlarged view of a portion of the door closing device shown in FIG. 1 illustrating another embodiment of the torsion spring used in the closing mechanism.

It is to be noted that the torsion spring 43 can be replaced with the one shown in FIG. 9 whose other end 43*c* is bent. Such structure can lessen the span L between the engaging portion 42*c* of the passive-lever 42 and the engaging portion 31*c* of the bracket 31. Moreover, the biasing force of the torsion spring 43 in the horizontal direction can be increased, which enables smooth return movement of the passive-lever 42 even though the movement of the passive-lever 42 from the initial position to the operating position is relatively large.

The principles, preferred embodiments, and modes of operation of the present invention have been described in the foregoing description. The invention which is intended to be protected herein should not, however, be construed as limited to the particular forms disclosed, as these are to be regarded as illustrative rather than restrictive. Variations and changes may be made by those skilled in the art, and equivalents employed, without departing from the spirit of the present invention. Accordingly, the foregoing detailed description should be considered exemplary in nature and not limited to the scope and spirit of the invention as set forth in the appended claims.

What is claimed is:

1. A door closing device comprising:

a door-lock mechanism for being positioned adjacent a door and a body, the door-lock mechanism including a latch member positionable on the door and having a groove for receiving a striker secured to the body;

a driving mechanism; and a door-closing mechanism for establishing a fully closed condition of the door relative to the body when the striker is positioned in the groove of the latch member, the door-closing mechanism including an active-lever operatively connected to the driving mechanism, a passive-lever operatively connected to the door-lock mechanism, and a cancel-lever disposed between the active-lever and the passive-lever for operatively connecting the active-lever to the passive-lever and for moving concurrently with the active-lever and the passive-lever, the cancel-lever being rotatable relative to one of the active-lever and the passive-lever for interrupting the operative connection between the active-lever and the passive-lever during concurrent movement of the active-lever, the passive-lever and the cancel-lever.

2. A door closing device in accordance with claim 1, wherein the cancel-lever is rotatably mounted on a projection extending from the passive-lever.

3. A door closing device in accordance with claim 2, wherein the projection extending from the passive-lever extends towards the active-lever and is press-formed.

4. A door closing device in accordance with claim 1, wherein said portion engaged by the cancel-lever is a projection extending from the active-lever.

5. A door closing device in accordance with claim 4, wherein the projection extending from the active-lever extends towards the passive-lever and is press-formed.

6. A door closing device in accordance with claim 1, wherein the active-lever and the passive-lever are mounted on a supporting bracket.

7. A door closing device in accordance with claim 6, wherein the active-lever, the cancel-lever, and the passive-lever are arranged adjacent to one another.

8. A door closing device in accordance with claim 6, wherein the body is a vehicle body.

9. A door closing device in accordance with claim 1, including a spring which operatively engages to the cancel-lever to urge the cancel-lever in a first direction.

10. A door closing device in accordance with claim 9, wherein said spring operatively engages said passive lever.

11. A door closing device in accordance with claim 1, wherein said passive-lever includes a projection that engages the cancel-lever.

* * * * *

UNITED STATES PATENT AND TRADEMARK OFFICE

CERTIFICATE OF CORRECTION

PATENT NO. : 5,454,607

DATED : October 3, 1995

INVENTOR(S) : Hiroshi ISHIHARA et al.

It is certified that error appears in the above-identified patent and that said Letters Patent is hereby corrected as shown below: Title page:

Item [73] Assignee, delete "Alsin" and insert -- Aisin --.

Signed and Sealed this

Twenty-first Day of April, 1998

Bruce Lehman

*Attest:*

BRUCE LEHMAN

*Attesting Officer*

*Commissioner of Patents and Trademarks*